US008105012B2

(12) United States Patent
Anema

(10) Patent No.: US 8,105,012 B2
(45) Date of Patent: Jan. 31, 2012

(54) ADJUSTABLE COMPRESSOR BLEED SYSTEM AND METHOD

(75) Inventor: Atte Anema, Enschede (NL)

(73) Assignee: Opra Technologies B.V., Hengelo (NL)

( * ) Notice: Subject to any disclaimer, the term of this patent is extended or adjusted under 35 U.S.C. 154(b) by 994 days.

(21) Appl. No.: 12/073,982

(22) Filed: Mar. 12, 2008

(65) Prior Publication Data

US 2009/0232642 A1 Sep. 17, 2009

(51) Int. Cl.
*F01D 25/26* (2006.01)

(52) U.S. Cl. ..... 415/108; 415/126; 415/145; 415/151; 415/224; 415/226

(58) Field of Classification Search ..... 415/108, 415/126, 184, 205, 224, 145, 226, 28, 151, 415/157; 60/782, 785
See application file for complete search history.

(56) References Cited

U.S. PATENT DOCUMENTS 3,893,787 A 7/1975 Jones
4,248,566 A 2/1981 Chapman et al.
4,479,755 A 10/1984 Skoe
4,687,412 A * 8/1987 Chamberlain ..... 415/134
4,743,161 A 5/1988 Fisher et al.
4,981,018 A 1/1991 Jones et al.
5,147,178 A 9/1992 Treece et al.
5,186,601 A 2/1993 Treece et al.
5,236,301 A 8/1993 Palmer
5,380,151 A 1/1995 Kostka et al.
6,183,195 B1 2/2001 Tremaine

* cited by examiner

*Primary Examiner* — Edward Look
*Assistant Examiner* — Adam W Brown
(74) *Attorney, Agent, or Firm* — Finnegan, Henderson, Farabow, Garrett & Dunner LLP

(57) ABSTRACT

An adjustable bleed apparatus and method for bleeding air to or from the impeller inlet region of a centrifugal compressor through a segmented annular bleed slot. An annular support member, connected to the fixed intake casing, supports a downstream annular shroud segment and an upstream annular shroud segment such that the downstream end of the downstream shroud segment is unconstrained. The spaced-apart distance between the shroud segments defines an annular bleed slot, which is segmented by bridge members. The connections between the shroud segments and the annular support member are configured such that the spaced apart distance of the annular bleed slot is adjustable. The connections between the annular support member and the fixed intake casing are configured such that the running clearance between the downstream shroud segment and the impeller is adjustable independently from the width of bleed slot.

13 Claims, 4 Drawing Sheets

ADJUSTABLE COMPRESSOR BLEED SYSTEM AND METHOD

BACKGROUND

1. Field of the Invention

This invention relates to centrifugal compressors, and more particularly to high performance centrifugal compressors using bleed apparatus in the impeller inlet region to regulate and stabilize certain operating parameters. This invention also relates to gas turbine power plants using such high performance centrifugal compressors.

2. Description of the Prior Art

Centrifugal compressors are used in various systems to provide high pressure air, which is often then directed to combustion chambers such as in a gas turbine power plant. Such compressors often experience flow instabilities during operation, especially during impeller acceleration and deceleration. The instabilities are generally caused by a shortage of air in the impeller inlet region during full-speed operation or a surplus of air during part-speed operation. A shortage of air, known as a choke condition, is typically caused by a rapid acceleration of the impeller, such that the increased compressor pumping capacity exceeds the system air intake capacity. A surplus of air, known as a surge condition, is typically caused by rapid deceleration of the impeller, leading to decreased compressor pumping capacity. Previous systems have bled air to and from the impeller inlet region to limit such instabilities.

For example, U.S. Pat. No. 4,248,566 to Chapman et al., entitled Dual Function Compressor Bleed, discloses a system employing an annular compressor shroud with a segmented annular slot configured to provide air to the impeller inlet region at full operating speed and remove air from the impeller inlet region at part operating speed. The patent discloses that such a system improves the operating efficiency of compressors by expanding surge margins and improving high speed flow capacity. One shortcoming in this design, however, is that the width of the bleed slot is fixed after production of the compressor. In addition, the annular shroud cannot be adjusted in a direction parallel to the compressor axis to set the running clearance between the impeller and shroud or to adjust the location of the bleed slot relative to the impeller. Moreover, the annular shroud is fixedly mounted to the structure near the impeller trailing edge. This configuration prevents controlled conformation of that portion of the shroud, decreasing system efficiency and increasing costs due to rubbing between the impeller and shroud.

U.S. Pat. No. 6,183,195 to Tremaine, entitled Single Slot Impeller Bleed, discloses a system employing a two-piece annular shroud where each segment is supported independently in a cantilevered manner to create an uninterrupted annular slot. While that system allows adjustment of both the running clearance and the width of the uninterrupted annular slot, those adjustments cannot be done independently. By adjusting the location of the downstream segment in the Tremaine construction, both the running clearance and the width of the uninterrupted annular slot change simultaneously. To change the running clearance but not the width of the bleed slot, thus, requires two sets of adjustments. This configuration therefore increases system complexity and assembly time. Moreover, the cantilevered mounting design requires that the shroud be fixedly mounted to the structure near the impeller trailing edge.

There is a need for a system that obviates or at least mitigates one or more of these shortcomings to allow efficient operation of a gas turbine power plant using a centrifugal compressor.

SUMMARY OF THE INVENTION

The present invention constitutes an adjustable bleed apparatus and method to achieve efficient operation of a centrifugal compressor by allowing independent adjustment of the width of a segmented annular bleed slot and the running clearance between the impeller and shroud as well as providing controlled conformation of the downstream shroud segment in the impeller exit region. Independent adjustments decrease system complexity and assembly time. Providing controlled conformation of the downstream shroud segment increases operating efficiency and decreases operating costs by reducing both structural stresses and component wear.

In one aspect, the adjustable bleed apparatus disclosed herein, for use in a compressor having an impeller containing blades and rotatable about an axis, an annular shroud surrounding the impeller, and a fixed intake casing, includes an annular support member configured for mounting to the fixed intake casing. The apparatus also includes a downstream annular shroud segment connected to the annular support member near the upstream end of the downstream annular shroud segment, the downstream end of the downstream shroud segment being unconstrained. The apparatus further includes an upstream annular shroud segment having a plurality of bridge members at the downstream end of the upstream shroud segment, the bridge members mounting a flange. The flange is connected to the annular member and the downstream shroud segment. The bridge members segment the annular bleed slot. The width of the segmented annular bleed slot is the spaced apart distance in the axial direction between the downstream end of the upstream shroud segment and the upstream end of the downstream shroud segment. The connections between the components of the adjustable bleed apparatus are configured such that the width of the segmented annular bleed slot is adjustable.

In another aspect, the method for bleeding air to or from the impeller inlet region includes configuring the annular shroud in two separate annular segments, an upstream shroud segment, and a downstream shroud segment, providing an annular support member connected to the fixed intake casing and connected to the upstream end of the downstream shroud segment, supporting, via the annular support member, the downstream end of the upstream shroud segment, which is spaced apart from the upstream end of the downstream shroud segment to provide a segmented annular bleed slot, and adjusting the width of the bleed slot to provide a desired bleed flow rate during compressor operation. Depending upon operating conditions, the air is bled to or from the impeller inlet region.

The accompanying drawings which are incorporated in and constitute a part of this specification, illustrate embodiments of the disclosed adjustable bleed apparatus and, together with the description, serve to explain the principles of the apparatus and method.

It is to be understood that both the foregoing general description and the following detailed description are exemplary and explanatory only and are not restrictive of the scope of the invention as claimed.

The accompanying drawings, which are incorporated in and constitute a part of this specification, illustrate several embodiments of the invention and together with the description serve to explain the principles of the invention.

DESCRIPTION OF THE DISCLOSED EMBODIMENTS

Figure 1:
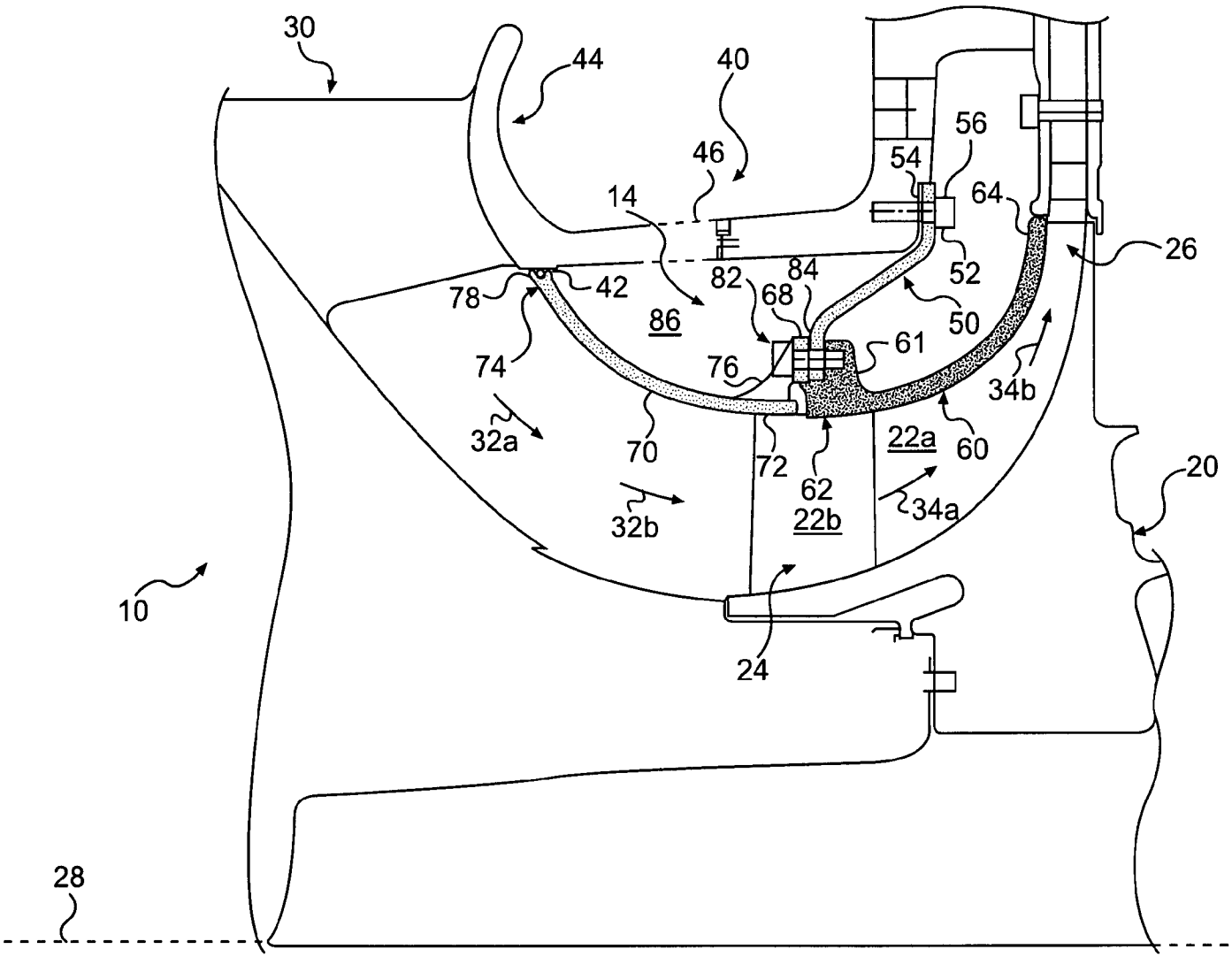
FIG. 1 is a schematic cross-sectional side view of a centrifugal compressor including an adjustable bleed apparatus in accordance with the present disclosure.

Referring to FIG. 1, a centrifugal compressor, designated generally by 10, is shown. Compressor 10 includes a compressor impeller, designated generally by 20, which has a plurality of impeller blades 22*a* and 22*b*, and an annular shroud designated generally by 14, together defining impeller inlet region 24 and impeller exit region 26. Impeller 20 is rotatable around compressor axis 28, which defines an axial direction and a radial direction. In addition, compressor 10 includes compressor casing intake region 30 and fixed intake casing 40, a portion of which forms casing inlet 44.

Air entering compressor casing intake region 30 flows downstream in the direction of flow arrows 32*a* and 32*b*, entering impeller inlet region 24 in the axial direction, generally parallel to compressor axis 28.

While being accelerated by impeller blades 22, the air flows further downstream in the direction of flow arrows 34*a* and 34*b* to impeller exit region 26, exiting in a radial direction, generally tangential to compressor axis 28.

In accordance with one aspect of the present disclosure, as embodied and broadly described herein, the adjustable bleed apparatus includes an annular support member configured for mounting to the fixed intake casing. In the embodiment shown in FIG. 1, annular support member 50 is connected to fixed intake casing 40 by connections 56 which include bolts 52. One skilled in the art would appreciate that other mounting configurations could be used, given the present disclosure.

Further in accordance with a first aspect of the present disclosure, as embodied and broadly described herein, the adjustable bleed apparatus includes downstream annular shroud segment 60 connected to annular support member 50 proximate upstream end 62 of downstream shroud segment 60 such that downstream end 64 of downstream shroud segment 60 is unconstrained during operation of compressor 10. Allowing downstream end 64 to operate unconstrained provides distinct advantages over the prior art. This configuration enables thermal and elastic conformation of downstream shroud segment 60, and more specifically downstream end 64, thereby preventing and/or substantially limiting rubbing between impeller blades 22 and downstream shroud segment 60. Potential component wear and structural stresses are thus reduced, leading to increased system efficiency and reduced operating costs.

Further in accordance with a first aspect of the present disclosure, as embodied and broadly described herein, the adjustable bleed apparatus includes upstream annular shroud segment 70, having a plurality of bridge members 76 at the downstream end 72 of upstream shroud segment 70. Bridge members 76 are connected to annular support member 50 and downstream shroud segment 60 by connections 68 distributed circumferentially such that downstream end 72 of upstream shroud segment 70 is axially spaced from upstream end 62 of downstream shroud segment 60 and segmented annular bleed slot 80 is formed. In the embodiment shown in FIG. 1, connections 68 include bolts 82 to connect downstream shroud segment 60, annular support member 50, and bridge members 76. To accommodate this connection, flange 61 of downstream shroud segment 60 is tapped with the thread configuration of bolts 82. In one embodiment, bridge members 76 and upstream shroud segment 70 are be integrally connected, such as by casting as one assembly.

Figure 2:
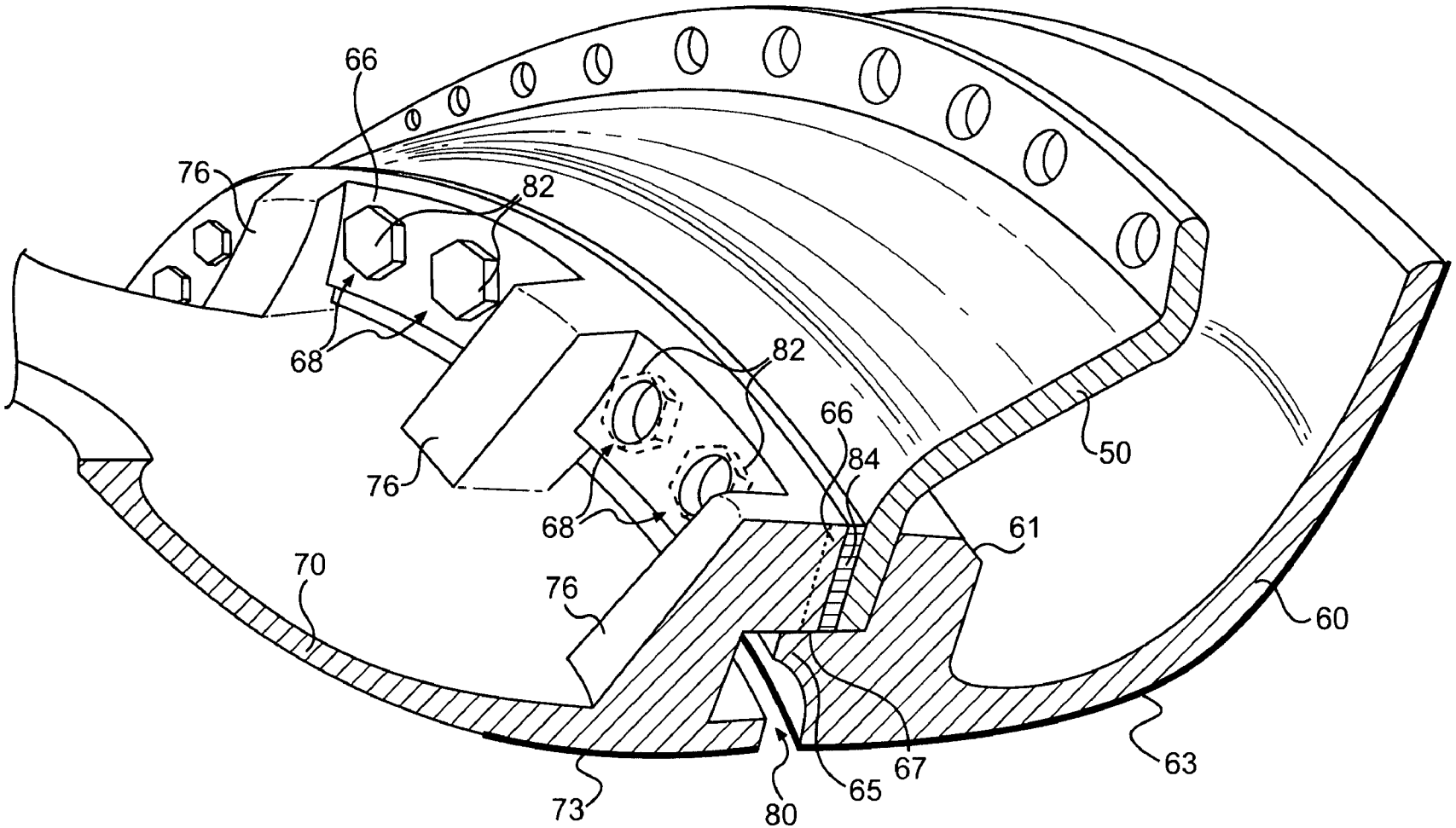
FIG. 2 is a perspective detail view of bridge members, the upstream and downstream annular shroud segments, and the annular support member of the embodiment of FIG. 1.

As shown in FIG. 2, the circumferential distance between each bridge member is spanned by a portion of a flange 66. In this embodiment, upstream shroud segment 70, flange 66, and bridge members 76 are integrally connected, such as by casting as one unit. Bolt holes in annular support member 50 and flange 61 are aligned with those in flange 66 to provide centering. Connections 68 include bolts 82, which interconnect flange 66, annular support member 50, and flange 61 of downstream shroud segment 60. One skilled in the art would appreciate that other connection configurations could be used, given the present disclosure.

In the embodiment shown in FIGS. 1 and 2, segmented annular bleed slot 80 is segmented by bridge members 76, which interrupt an otherwise continuous opening when segmented annular bleed slot 80 is circumferentially traversed. FIG. 2 depicts three of approximately ten bridges comprising bridge members 76. This embodiment is merely exemplary and other embodiments may include more or fewer bridge members.

Connections 68 are configured to enable adjustment of the width of segmented annular bleed slot 80. In the embodiment shown in FIGS. 1 and 2, connections 68 include one or more spacers 84 to adjust the width. One skilled in the art would appreciate that other spacing configurations could be used, given the present disclosure.

As discussed generally above, segmented annular bleed slot 80 allows both air flow from and to impeller inlet region 24 depending upon compressor operating conditions, as one skilled in the art would understand. U.S. Pat. No. 4,248,566 to Chapman et al. and U.S. Pat. No. 6,183,195 to Tremaine discuss the use of bleed slots to regulate and stabilize operating parameters during centrifugal compressor operation. The teachings of these two references are incorporated herein by reference.

Generally, during full-speed impeller operation, operating conditions cause air to flow through the bleed slot in the direction of the impeller inlet region. In contrast, during part-speed impeller operation, static pressure differences cause air to flow through the bleed slot in the opposite direction. This occurrence will generally be termed "bleeding" air to and from the impeller inlet region. As taught in the prior art references and discussed above, allowing such bleeding optimizes compressor operation and efficiency.

Adjusting the width of segmented annular bleed slot 80 could be required due to a number of factors, including but not limited to ambient air temperatures, planned operating speed, the presence or absence of openings or conduits, turbine design, and/or impeller rotor design.

Further in accordance with a first aspect of the present disclosure, connections 56 between annular support member 50 and fixed intake casing 40 may be configured to enable adjustment of the axial position of an assembly comprising upstream shroud segment 70, downstream shroud segment 60, and annular support member 50 relative to impeller blades 22. This adjustment enables setting the optimum running clearance between downstream shroud segment 60 and impeller blades 22 while maintaining the width of segmented annular bleed slot 80. In the embodiment shown in FIG. 1, shims 54 enable such adjustment. One skilled in the art would appreciate that other configurations for connections 56 could be used, given the present disclosure.

Running clearance adjustments between downstream shroud segment 60 and impeller blades 22 could be required due to a number of factors, including but not limited to ambient air temperatures, planned operating speed, the presence or absence of piping or passages from the annular cavity, turbine design, impeller rotor design, and/or the choice of materials used in the impeller and annular shroud.

In addition, compressor inefficiencies may result if the running clearance between downstream shroud segment 60 and impeller blades 22 is not properly adjusted. If the running clearance is too large, air will leak around impeller blades 22, preventing compressor 10 from reaching the peak potential pressure ratio between impeller inlet region 24 and a diffuser (not shown) receiving high velocity air from impeller exit region 26. If the running clearance is too small, impeller blades 22 will rub on downstream shroud segment 60, causing system friction and material wear. Setting the optimum running clearance thus results in the highest pressure ratio, pumping capacity, and operating efficiency for compressor 10.

However, it may nonetheless be preferred to include an abradable coating such as aluminum coating 63, depicted in FIG. 2 on the surface of shroud segment 60 adjacent impeller blades 22*a*, 22*b*. It may also be preferred to include an abradable coating such as aluminum coating 73 on at least that portion of the inner surface of upstream shroud segment 70 opposing impeller blades 22*a*, 22*b*. See FIG. 1.

Still further, upstream shroud segment 60, spacers 84, annular support member 50, and downstream shroud segment 60 may be preassembled and clamped in a machine setup, and abradable coatings 63 and 73 final machined at the same time to ensure matched and aligned inner coated surfaces. As one skilled in the art would appreciate, shoulder 65 of downstream shroud segment 60 provides an axial alignment function by engaging inner surface 67 of flange 66, thereby acting as a pilot or "spigot" to center upstream shroud segment 70 relative to downstream segment 60 during assembly.

Unlike the configurations disclosed in the prior art, adjustments to the width of segmented annular bleed slot 80 and adjustment to the axial position of the adjustable bleed apparatus relative to impeller 20 can be made independently in the present invention. Such independence provides a number of distinct advantages including, but not limited to, decreased system complexity and compressor assembly time. In addition, the configuration of the present invention may allow the adjustable bleed apparatus to be shipped as one complete assembly.

Still further in accordance with the present disclosure, the adjustable bleed apparatus may include an annular cavity 86, which is generally formed by the annular volume between upstream shroud segment 70, fixed intake casing 40, and annular support member 50. As discussed above, during part-speed impeller operation, air from impeller inlet region 24 bleeds from impeller inlet region 24, through segmented annular bleed slot 80, past bridge members 76, and into cavity 86. During full-speed impeller operation, however, air bleeds from cavity 86, past bridge members 76, through segmented annular bleed slot 80 into impeller inlet region 24.

Further in accordance with the present disclosure, the adjustable bleed apparatus may include seal 78 between upstream end 74 of upstream shroud segment 70 and land 42 on fixed intake casing 40 to prevent leakage of air past upstream shroud segment 70 in either direction. In the embodiment shown in FIG. 1, seal 78 is a rubber o-ring. One skilled in the art would appreciate that other sealing means could be used, given the present disclosure.

Land 42 must be sufficiently wide to prevent disturbed airflow between compressor casing intake region 30 and impeller inlet region 24 while permitting axial movement of upstream shroud segment 70 due to the potential adjustment of one or both of the width of segmented annular bleed slot 80 via spacers 84 and the axial position of the adjustable bleed apparatus relative to impeller 20 via shims 54. Seal 78 must also be configured to permit axial translation by upstream shroud segment 70 on land 42.

Figure 3:
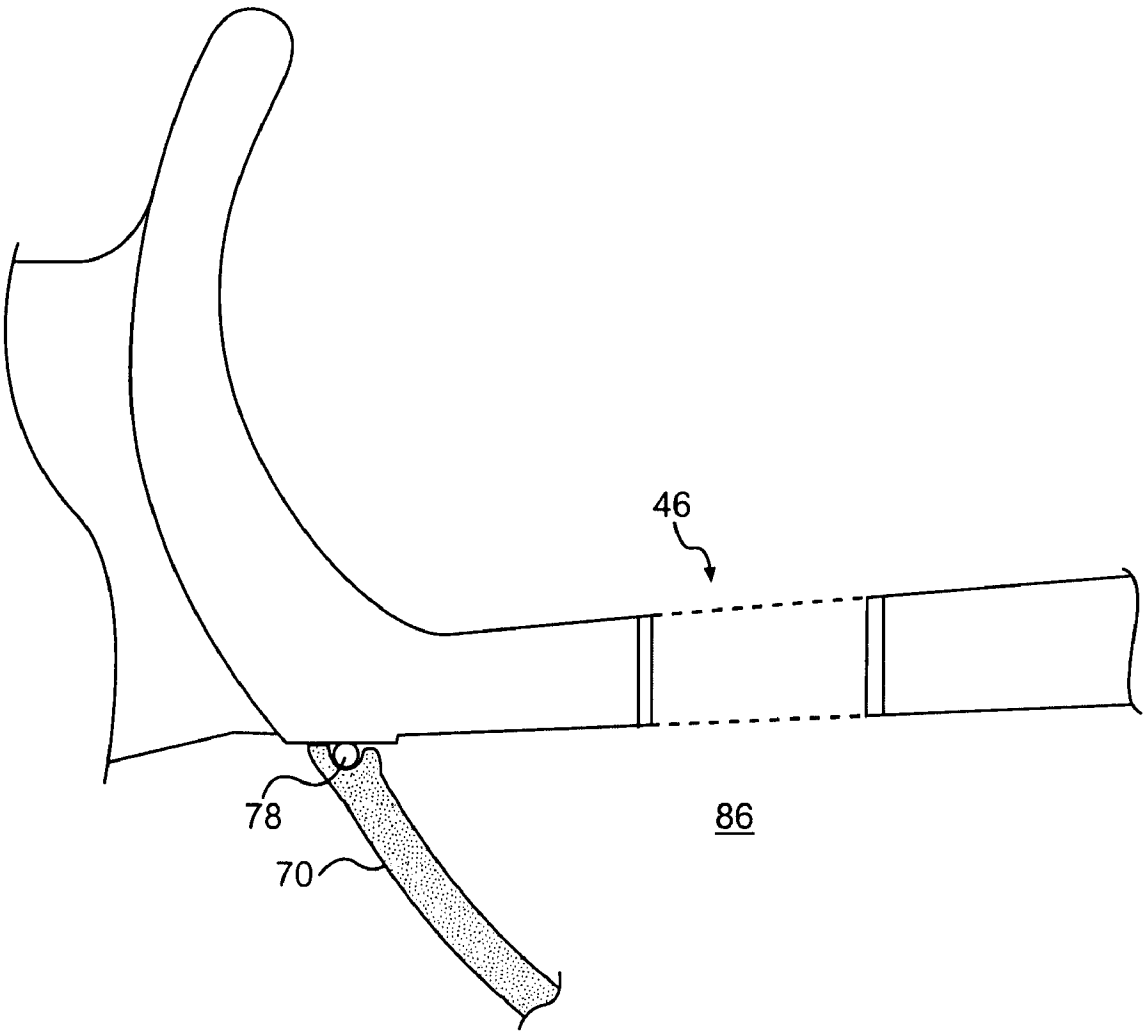
FIG. 3 is a schematic detailed cross-sectional side view of the fixed intake casing in the FIG. 1 embodiment.

In an embodiment shown in FIG. 3, the adjustable bleed apparatus could also include openings 46 in fixed intake casing 40, allowing air flow in both directions between cavity 86 and the atmosphere outside compressor 10. One advantage of this configuration is increased compressor efficiency. For example, during steady-state full-speed impeller operation, one or more openings 46 would enable cavity 86 to provide a continuous flow of air because the air supply would not be limited to only that in cavity 86. In a similar manner, during steady-state part-speed impeller operation, openings 46 would enable annular cavity 86 to vent a continuous flow of air because the system venting capacity would not be limited to the volume of cavity 86.

Figure 4:
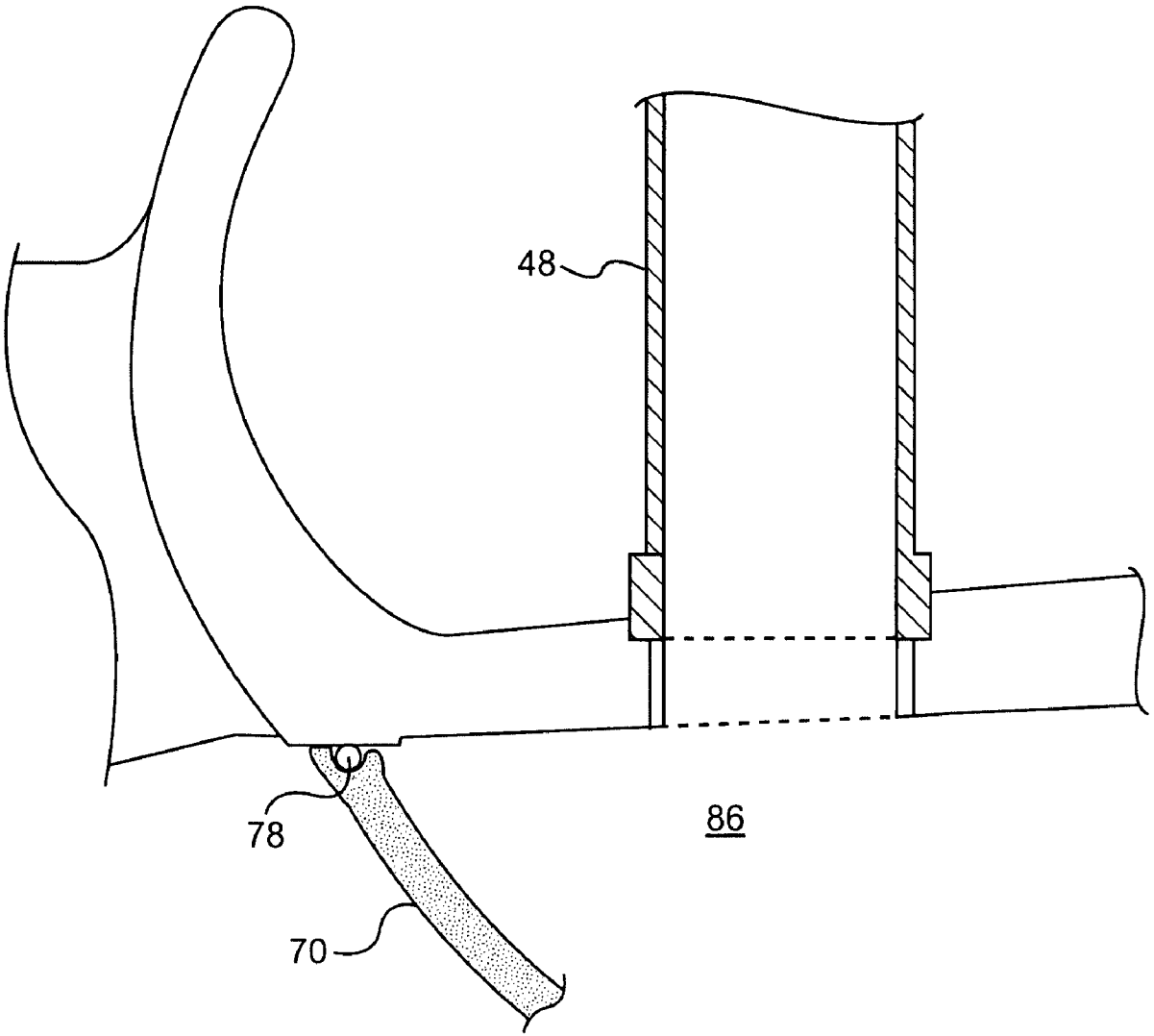
FIG. 4 is a schematic detailed cross-sectional side view of a variation of the fixed intake casing of the FIG. 1 embodiment including conduits between the annular cavity and the atmosphere.

In another embodiment, shown in FIG. 4, instead of openings 46 directly to the atmosphere, air exits and enters cavity 86 from the atmosphere through one or more conduits 48. In this embodiment, a performance gain may result over the embodiment in FIG. 3 because bleed air is dumped further away from compressor casing intake region 30. Allowing hotter and thus less dense bleed air to mix with colder air entering compressor casing intake region 30 may lead to decreased efficiency and decreased compressor pumping capacity.

An apparatus as disclosed above can be utilized in a method to bleed air to and/or from the impeller inlet region inlet of a centrifugal compressor. In accordance with a second aspect of the present disclosure, the method includes configuring the annular shroud in two separate annular segments, an upstream shroud segment and a downstream shroud segment. An annular support member is provided and connected to the fixed intake casing and the upstream end of the downstream shroud segment. The downstream end of the upstream shroud segment is attached to the upstream end of the downstream shroud segment, with the two segments being spaced apart by a plurality of bridge members to form a segmented annular bleed slot with the bridge members interrupting the slot. In this manner, the annular support member provides support to the annular shroud.

The width of the segmented annular bleed slot is adjusted to provide the desired bleed flow rate during compressor operation. In one embodiment, the adjustment is made by removing and/or replacing spacers. As discussed above, adjustments to the width of the segmented annular bleed slot could be required due to a number of factors.

Further in accordance with a second aspect of the present disclosure, the axial position of the assembly comprising the upstream and downstream annular shroud segments and annular support member is adjusted relative to the impeller to provide the proper running clearance between the impeller and the downstream shroud segment As discussed above, this adjustment could be required due to a number of factors. Also as discussed above, adjustments to the width of the segmented annular bleed slot and the running clearance can be made independently in the present invention.

Further in accordance with a second aspect of the present disclosure, during operation, air bleeding to or from the impeller inlet region through the segmented annular bleed slot may be transmitted to or from the atmosphere outside the compressor.

It will be apparent to those skilled in the art that various modifications and variations could be made in the adjustable bleed apparatus and method of the present invention without departing from the scope or the spirit of the invention. Furthermore, it is intended that the disclosed invention not be limited by the foregoing examples, but only by the following claims and equivalents.

As described above, therefore, other embodiments of the invention will be apparent to those skilled in the art from consideration of the specification and practice of the invention disclosed herein. It is intended that the specification and examples be considered as exemplary only.

What is claimed is:

1. An adjustable bleed apparatus for bleeding air to or from an impeller inlet region of a centrifugal compressor, the compressor including a compressor impeller rotatable about an axis and having a plurality of blades, an annular shroud surrounding the impeller, and a fixed intake casing, the shroud, impeller and blades defining a flow path through the compressor, the apparatus comprising:

an annular support member configured for mounting to the fixed intake casing;

a downstream annular shroud segment connected to the annular support member by a first plurality of connections proximate an upstream end of the downstream annular shroud segment, a downstream end of the downstream shroud segment being unconstrained; and an upstream annular shroud segment having a plurality of bridge members at a downstream end of the upstream shroud segment, the bridge members mounting a flange, the flange being connected to the annular member and the downstream shroud segment by the plurality of first connections, wherein each of the first connections is configured to space apart the downstream end of the upstream shroud segment from the upstream end of the downstream shroud segment a distance in the axial direction, the spaced-apart distance comprising the width of a segmented annular bleed slot for bleeding air to or from the impeller inlet region past the bridge members, and wherein each of the first connections also is configured to provide an adjustable spaced-apart distance.

2. The apparatus as in claim 1, wherein the bridge members are fixedly connected to the flange and the upstream shroud segment.

3. The apparatus as in claim 1, wherein the annular support member is mounted to the fixed intake casing by a plurality of second connections, wherein the second plurality of connections are configured to provide an adjustable axial position of an assembly comprising the annular support member and connected upstream and downstream shroud segments, relative to the impeller, the width of the segmented annular bleed slot and the adjustable axial position of the assembly being adjustable independent of one another.

4. The apparatus as in claim 1, wherein an annular cavity is formed by the fixed intake casing, the upstream shroud segment, and the annular support member, and wherein bleeding air exiting or entering the impeller inlet region through the segmented annular bleed slot respectively exits or enters the cavity through one or more openings through the intake casing.

5. The apparatus as in claim 3, further comprising a sealing means slidingly engaged between the upstream shroud segment and a land on the fixed intake casing for preventing leakage of air to or from the cavity past the upstream shroud segment and the land.

6. The apparatus as in claim 4, further including one or more conduits flow connecting the one or more openings to the atmosphere.

7. The apparatus as in claim 1, wherein the downstream shroud segment includes a flange mounted to the upstream end of the downstream shroud segment, the second flange being configured to be connected to the flange on the downstream end of the upstream shroud segment and the annular member by the first connections; and wherein the flange mounted to the downstream shroud segment includes a shoulder configured to engage the flange on the upstream shroud segment to axially align the upstream and downstream shroud segments relative to one another.

8. A gas turbine power plant comprising:

a centrifugal compressor including a compressor impeller rotatable about an axis and having a plurality of blades, an annular shroud surrounding the impeller, and a fixed intake casing, the shroud, impeller and blades defining a flow path through the compressor, the compressor also having an impeller inlet region; and an adjustable bleed apparatus comprising:

an annular support member configured for mounting to the fixed intake casing; a downstream annular shroud segment connected to the annular support member by a first plurality of connections proximate an upstream end of the downstream annular shroud segment, a downstream end of the downstream shroud segment being unconstrained; and an upstream annular shroud segment having a plurality of bridge members at a downstream end of the upstream shroud segment, the bridge members mounting a flange, the flange being connected to the annular member and the downstream shroud segment by the plurality of first connections, wherein each of the first connections is configured to space apart the downstream end of the upstream shroud segment from the upstream end of the downstream shroud segment a distance in the axial direction, the spaced-apart distance comprising the width of a segmented annular bleed slot for bleeding air to or from the impeller inlet region past the bridge members, and wherein each of the first connections also is configured to provide an adjustable spaced-apart distance.

9. A centrifugal compressor comprising:

an impeller rotatable about an axis and having a plurality of blades;

an annular shroud surrounding the impeller;

a fixed intake casing and an impeller inlet region, wherein the shroud, impeller and blades define a flow path through the compressor, and an annular support member configured for mounting to the fixed intake casing; a downstream annular shroud segment connected to the annular support member by a first plurality of connections proximate an upstream end of the downstream annular shroud segment, a downstream end of the downstream shroud segment being unconstrained; and an upstream annular shroud segment having a plurality of bridge members at a downstream end of the upstream shroud segment, the bridge members mounting a flange, the flange being connected to the annular member and the downstream shroud segment by the plurality of first connections, wherein each of the first connections is configured to space apart the downstream end of the upstream shroud segment from the upstream end of the downstream shroud segment a distance in the axial direction, the spaced-apart distance comprising the width of a segmented annular bleed slot for bleeding air to or from the impeller inlet region past the bridge members, and wherein each of the first connections also is configured to provide an adjustable spaced-apart distance.

10. A method for bleeding air to or from an impeller inlet region of a centrifugal compressor, the compressor having a rotor assembly rotatably supported within an annular shroud attached to a fixed intake casing, the method comprising:

configuring the annular shroud in two separate annular segments, an upstream shroud segment, and a downstream shroud segment;

providing an annular support member connected to the fixed intake casing and connected to an upstream end of the downstream shroud segment;

supporting, via the annular support member, a downstream end of the upstream shroud segment spaced apart from the upstream end of the downstream shroud segment to provide a segmented annular bleed slot; and adjusting the spaced apart width of the bleed slot to provide a desired bleed flow rate during operation.

11. The method as in claim 10, further comprising adjusting the axial position of the annular shroud and annular support member relative to the impeller, wherein adjusting the axial position is done independently from adjusting the bleed slot width.

12. The method as in claim 10, further comprising transmitting air between the impeller inlet region and the atmosphere.

13. The method as in claim 10, wherein providing an annular support member connected to an upstream end of the downstream shroud segment includes leaving the downstream end of the downstream shroud segment unconstrained.

* * * * *

UNITED STATES PATENT AND TRADEMARK OFFICE

CERTIFICATE OF CORRECTION

PATENT NO. : 8,105,012 B2
APPLICATION NO. : 12/073982
DATED : January 31, 2012
INVENTOR(S) : Atte Anema It is certified that error appears in the above-identified patent and that said Letters Patent is hereby corrected as shown below:

In claim 9, column 8, line 58, after "compressor, and" insert as a new paragraph -- an adjustable bleed apparatus comprising: --.

Signed and Sealed this
Third Day of April, 2012

David J. Kappos

David J. Kappos
*Director of the United States Patent and Trademark Office*